US009111468B2

(12) United States Patent
Kirschner et al.

(10) Patent No.: US 9,111,468 B2
(45) Date of Patent: Aug. 18, 2015

(54) OVERHEAD SUPPORT APPARATUS

(71) Applicant: iLight Technologies, Inc., Chicago, IL (US)

(72) Inventors: Chad Glenn Kirschner, West Dundee, IL (US); Sean Edward Callahan, Elmhurst, IL (US); Mark Joseph Cleaver, Chicago, IL (US); Quisheng Chen, Heshan (CN); Zhiping Zhang, Heshan (CN)

(73) Assignee: iLight Technologies, Inc., Chicago, IL (US)

( * ) Notice: Subject to any disclaimer, the term of this patent is extended or adjusted under 35 U.S.C. 154(b) by 0 days.

(21) Appl. No.: 14/488,559

(22) Filed: Sep. 17, 2014

(65) Prior Publication Data

US 2015/0007470 A1 Jan. 8, 2015

Related U.S. Application Data

(63) Continuation of application No. 13/657,305, filed on Oct. 22, 2012, now Pat. No. 8,839,537.

(51) Int. Cl.
*G09F 7/16* (2006.01)
*G09F 9/302* (2006.01)
(Continued)

(52) U.S. Cl.
CPC *G09F 9/302* (2013.01); *G09F 7/14* (2013.01); *G09F 7/18* (2013.01); *G09F 2007/186* (2013.01)

(58) Field of Classification Search
CPC ..... G09F 7/16; G09F 7/18; G09F 2007/186; G09F 13/0404; F16L 9/18; F16L 3/14; F16L 3/11
USPC ..... 40/596, 617, 552, 300; D8/373, 371, D8/366; 248/300
See application file for complete search history.

(56) References Cited

U.S. PATENT DOCUMENTS 999,961 A 8/1911 Colas
2,421,447 A * 6/1947 Watkins ..... 248/343
(Continued)

FOREIGN PATENT DOCUMENTS

| | | |
|---|---|---|
| MD | 3869 | 3/2009 |
| RU | 13532 | 4/2000 |
| SU | 564832 | 7/1977 |

OTHER PUBLICATIONS

Catalogue: Banner profiles, Oct. 19, 2012 [online] [retrieved on Jan. 28, 2014] Retrieved from the Internet: <URL:http://www.helvetica-sochi.ru/catalog-07-sochi.html>.
(Continued)

*Primary Examiner* — Casandra Davis
(74) *Attorney, Agent, or Firm* — Fitch Even Tabin & Flannery LLP

(57) ABSTRACT

A support component comprises a tab configured to be coupled to a bar (as comprises a part of an item to be suspended), the tab including a plurality of openings disposed therethrough and configured to receive an overhead support interface (such as a corresponding flexible link) to thereby provide overhead support to the bar. These openings can be laterally offset from one another to facilitate selecting a particular pitch orientation for the bar. The tab can have a non-circular hole disposed therethrough sized and configured to receive the bar. This hole can include a surface that is configured to key with respect to a corresponding bar surface to thereby prevent the bar from rotating.

15 Claims, 11 Drawing Sheets

(51) Int. Cl.
*G09F 7/18* (2006.01)
*G09F 7/14* (2006.01)

(56) References Cited

U.S. PATENT DOCUMENTS

| | | | | |
|---|---|---|---|---|
| D313,550 | S | 1/1991 | Lorincz | |
| D344,543 | S * | 2/1994 | Lemon | D19/59 |
| 5,409,191 | A | 4/1995 | Wenmaekers | |
| 5,606,816 | A | 3/1997 | Schwartz | |
| 5,620,274 | A | 4/1997 | Wear | |
| D423,050 | S * | 4/2000 | Rink et al. | D19/59 |
| D438,092 | S | 2/2001 | Schmidt | |
| D658,489 | S | 5/2012 | Vassallo | |
| 8,186,509 | B2 * | 5/2012 | Samelson | 206/326 |
| D670,996 | S | 11/2012 | Rogers | |
| D684,146 | S | 6/2013 | Stifal | |
| D684,147 | S | 6/2013 | Stifal | |
| D686,908 | S | 7/2013 | Kyle | |
| 8,839,537 | B2 | 9/2014 | Kirschner | |
| 2009/0277060 | A1 | 11/2009 | Wiltfang | |

OTHER PUBLICATIONS

International Search Report and Written Opinion by the International Searching Authority from PCT/US2013/065411 Dated Feb. 13, 2014.

Podvesnoy alyuminievy profil. Sep. 10, 2013 [online] [retrieved on Jan. 28, 2014] Retrieved from the Internet: <URL:http//www.indexeventus.ru/News/2013-09-10.sub.--podvesnoj.sub.--a-lyuminievyj.sub.--profil>.

* cited by examiner

OVERHEAD SUPPORT APPARATUS

RELATED APPLICATION(S)

This is a continuation of U.S. patent application Ser. No. 13/657,305, filed Oct. 22, 2012, entitled OVERHEAD SUPPORT APPARATUS, which is incorporated by reference in its entirety herein.

This application is related to co-pending and co-owned patent application number PCT/US12/49970, entitled Apparatus Pertaining to Physically-Discrete Sign Components and filed Aug. 8, 2012, which is incorporated by reference in its entirety herein.

TECHNICAL FIELD

This invention relates generally to overhead support components.

BACKGROUND

Many items are designed and configured to be installed in a suspended state. As used herein, the expression "suspended state" will be understood to refer to being hung from above by a flexible link (such as a rope, string, wire, chain, or the like) as versus a rigid link (such as a beam, pipe, rod, or the like). As one useful example in these regards, some signs include openings (for example, through the uppermost corners of the sign) to receive a flexible link that is, in turn, secured to a ceiling or other overhead component. In many cases such items are suspended via two or more flexible links, with one flexible link being located near or at one side edge of the item and another flexible link being located near or at an opposing side edge of the item.

When the item being suspended has a ratio of its length to its height that is relatively large (and particularly as the depth of the item becomes more shallow), it becomes increasingly possible that the item will bow when flexibly suspended. For example, the item can bow outwardly and downwardly in its middle section. Additional flexible links are sometimes used to attempt to ameliorate this phenomenon with varying degrees of success and varying levels of difficulty as regards installing and adjusting such additional flexible links.

Complicating the foregoing is a wish to sometimes adjust the pitch of the item in its suspended state. For example, when the item comprises a sign it may be useful to pitch the item downwardly somewhat in order to facilitate observing the sign's content. Typical items designed for installation in a suspended state, however, tend to assume a one-size-fits-all solution that essentially ignores such a need.

BRIEF DESCRIPTION OF THE DRAWINGS

The above needs are at least partially met through provision of the overhead support apparatus described in the following detailed description, particularly when studied in conjunction with the drawings, wherein.

Figure 2:
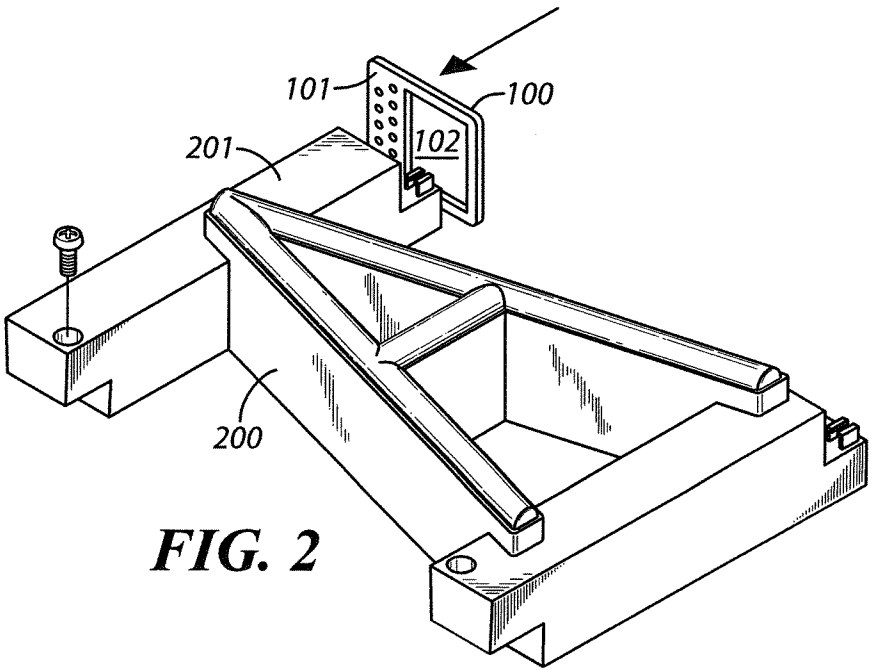
FIG. 2 comprises a perspective view as configured in accordance with various embodiments of the invention.

Elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments of the present invention. Certain actions and/or steps may be described or depicted in a particular order of occurrence while those skilled in the art will understand that such specificity with respect to sequence is not actually required. The terms and expressions used herein have the ordinary technical meaning as is accorded to such terms and expressions by persons skilled in the technical field as set forth above except where different specific meanings have otherwise been set forth herein.

DETAILED DESCRIPTION

Generally speaking, pursuant to these various embodiments, a support component can comprise a tab configured to be coupled to a bar (as comprises a part of an item to be suspended), the tab including a plurality of captivation points disposed therethrough (or otherwise formed therein) that are each configured to receive an overhead support interface (such as a corresponding flexible link) to thereby permit at least one of these captivation points to provide overhead support to the bar. By one approach the plurality of captivation points are laterally offset from one another to thereby facilitate selecting a particular pitch orientation for the bar.

These teachings will accommodate a variety of differently-formed captivation points. By one approach, for example, at least some of the captivation points can comprise holes formed through the tab. By another approach, in combination with the foregoing or in lieu thereof, at least some of the captivation points can comprise notches formed in the tab.

By one approach the tab has a non-circular hole disposed therethrough sized and configured to receive the bar to thereby couple the tab to the bar. This non-circular hole can include a surface that is configured to key with respect to a corresponding bar surface to thereby prevent the bar from rotating about a longitudinal axis. These teachings are highly flexible in these regards and will accommodate a wide variety of variations in these regards including bars having a rectangular cross section, a triangular cross section, a hexagonal cross section, an oval cross section, and any of a variety of other symmetrical or nonsymmetrical cross sections.

By one approach the aforementioned plurality of captivation points can comprise a plurality of rows of a plurality of such captivation points. For example, the tab can include a first row of a first plurality of captivation points and a second row of a second plurality of captivation points. In such a case, if desired, the first plurality of captivation points can be laterally offset with respect to the captivation points of the second plurality of captivation points to thereby provide an increased number of pitch adjustment opportunities.

So configured, one or more such support components can be employed with, for example, a sign comprised of a plurality of physically-discrete sign components that are serially attached to one another. In particular, such a support component can be disposed and coupled between two such physically-discrete sign components that are adjacent to one another. So disposed, an overhead support interface (such as a hook that connects to a flexible link that hangs from an overhead location such as a ceiling) can be coupled to a selected one of the aforementioned captivation points to thereby provide supplemental overhead support to the sign and, as desired, to facilitate selecting a particular pitch orientation for the sign.

Such a support component can be readily employed at a time of installation to accommodate any of a variety of installation challenges and/or requirements. These teachings are highly flexible in practice and will accommodate use with items to be suspended having any of a variety of shapes and sizes. Such a support component can be economically manufactured and is relatively intuitive to successfully utilize.

Figure 1:
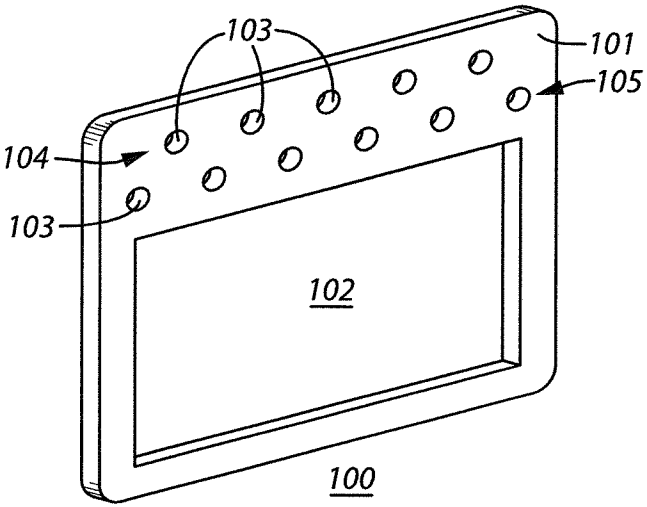
FIG. 1 comprises a perspective view as configured in accordance with various embodiments of the invention.

These and other benefits may become clearer upon making a thorough review and study of the following detailed description. Referring now to the drawings, and in particular to FIG. 1, an illustrative example of a support component 100 will be described. This support component 100 comprises a tab 101 comprising, in this example, a flat plate having a generally rectangular shape. It will be understood that other shapes can be readily accommodated, however, including non-planar surfaces if desired.

This tab 101 can be comprised of any suitable material such as plastic, metal, or even wood. Generally speaking the tab 101 is substantially resilient though a small amount of flexibility may be useful in some application settings. Depending upon the weight of the item to be suspended and the support provided by other support elements, even a material such as cardboard (or other relatively stiff paper stock) can serve in these regards.

The size of the tab 101 can vary with respect to the needs and/or opportunities that tend to characterize a given application setting. For example, the larger the bar of the item to be suspended, typically the larger the tab 101 and vice versa.

This tab 101 is configured to be coupled to a bar (not shown in this illustration). Generally speaking, this accommodation comprises, at least in part, a non-circular hole 102 disposed through the tab 101. This non-circular hole 102 is configured to receive the aforementioned bar to thereby couple the tab 101 to the bar. Accordingly, in many cases it will be useful if the non-circular hole 102 substantially conformally corresponds to the external cross-sectional form factor of the bar. In this illustrative example, it is presumed that the bar has a rectangular external cross section and accordingly the non-circular hole 102 has a rectangular shape as well.

As will be exemplified in more detail below, these teachings will accommodate a wide variety of shapes for this hole 102. Generally speaking, the non-circular hole 102 has at least one internal surface that is configured to key with respect to a corresponding bar surface to thereby prevent the bar from rotating about a longitudinal axis. When, for example, the bar has a rectangular external cross section as is presumed in the present example, and the non-circular hole 102 comprises a corresponding rectangle that conforms rather closely to the size of the bar, the tab 101 and the bar interact in a way that prevents the bar from rotating about its longitudinal axis.

The support component 100 also includes a plurality of captivation points disposed through the tab 101. For the purposes of this initial example it will be presumed that the captivation points all comprise openings 103 that are disposed through the tab 101. As will be exemplified further below, however, the present teachings are not limited to only openings and it will therefore be understood that the use of openings is intended to serve only in an illustrative capacity.

Generally speaking, these openings 103 are configured to receive an overhead support interface (such as a flexible link that passes therethrough or a hook or latch that is attached to a flexible link) to thereby provide overhead support to the aforementioned bar. For the sake of clarity and simplicity these openings 103 are shown here as being circles. It will be understood, however, that these openings can have any of a variety of regular geometric shapes (such as squares, triangles, rectangles, and so forth) or irregular shapes. Also for the sake of clarity and simplicity these openings 103 are shown here as all having a same shape and size. In fact, the size and shape of each opening 103 can vary as may be desired.

By one approach, these openings 103 are laterally offset from one another (as versus being merely vertically stacked with respect to one another) to thereby facilitate a user selecting a particular pitch orientation for the bar (as described below in more detail).

By one approach, and as illustrated, this plurality of openings 103 can comprise a first row 104 of a first plurality of the openings 103 and a second row 105 of a second plurality of the openings 103. In such a case, and if desired, the openings 103 of the first row 104 can be laterally offset with respect to the openings 103 of the second row 105. Such a configuration can provide an increased number of pitch-selection opportunities within a given lateral space.

As referenced above, such a support component 100 is configured to be coupled to a bar of an item to be suspended from overhead. For the sake of an example a description of a particular such support component 100 as used in conjunction with a particular item to be suspended (in particular, a sign comprised of a plurality of physically-discrete sign components that are serially attached to one another) will now be provided. It will be understood, however, that this example is intended to serve in an illustrative capacity and that no limitations with respect to the scope of these teachings are intended by way of the specifics of this example.

In this example, each physically-discrete sign component 200 includes a bar 201 that is configured to couple to the corresponding bar of an adjacent physically-discrete sign component (not shown in this figure). This bar 201 has a generally rectangular external cross section. As shown in this figure the support component 100 can be slid into place by moving the support component 100 to receive bar 201 through the non-circular hole 102.

Figure 3:
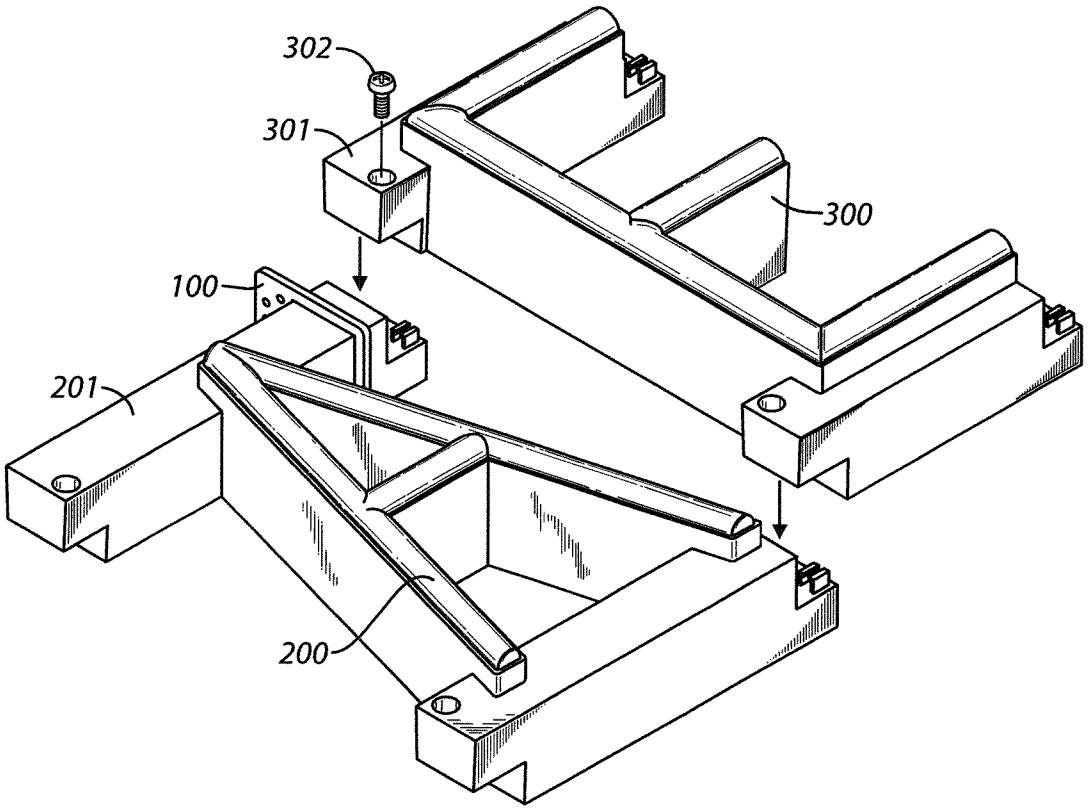
FIG. 3 comprises a perspective view as configured in accordance with various embodiments of the invention.

Referring now to FIG. 3, a second such physically-discrete sign component 300 is now attached to the aforementioned physically-discrete sign component 200. In particular, in addition to such other connections as may be desired the bar 301 of the second physically-discrete sign component 300 is secured to the bar 201 of the aforementioned physically-discrete sign component 200 using, in this case, a threaded member 302 such as a screw.

Figure 4:
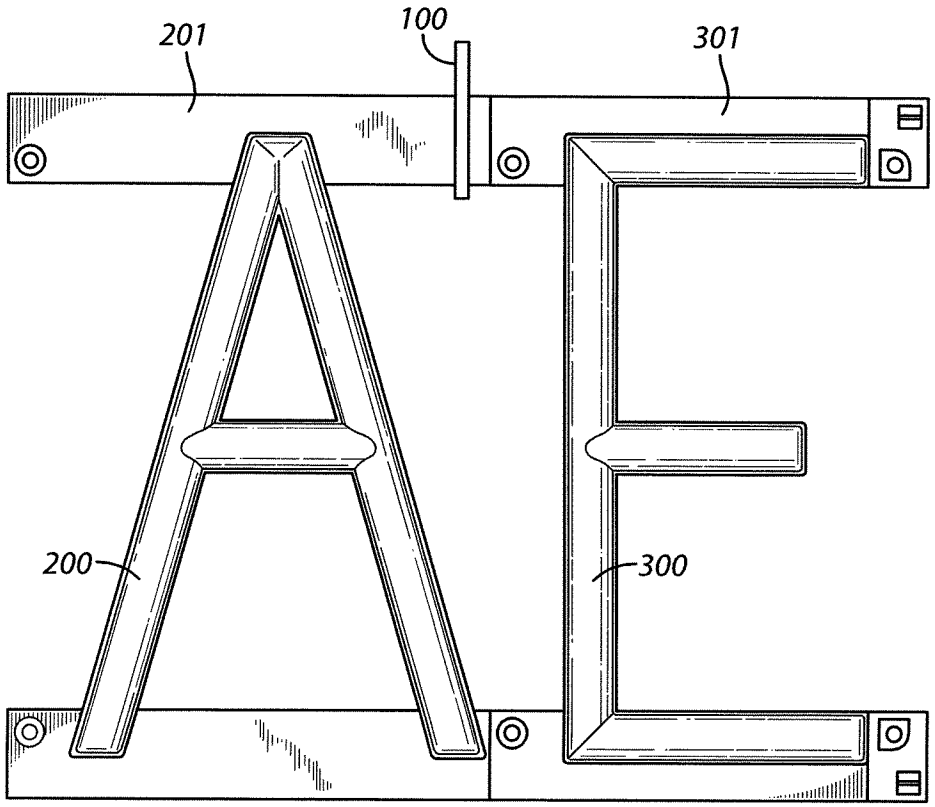
FIG. 4 comprises a front elevational view as configured in accordance with various embodiments of the invention.

Referring now to FIG. 4, the foregoing steps yield a sign subassembly comprising the first physically-discrete sign component 200 as secured to the second physically-discrete sign component 300. The support component 100, in turn, can now be slid along the bars 201 and 301 of the two physically-discrete sign components 200 and 300 between the alphabetic characters to adjust, if desired, a particular installed location for the support component 100.

Figure 5:
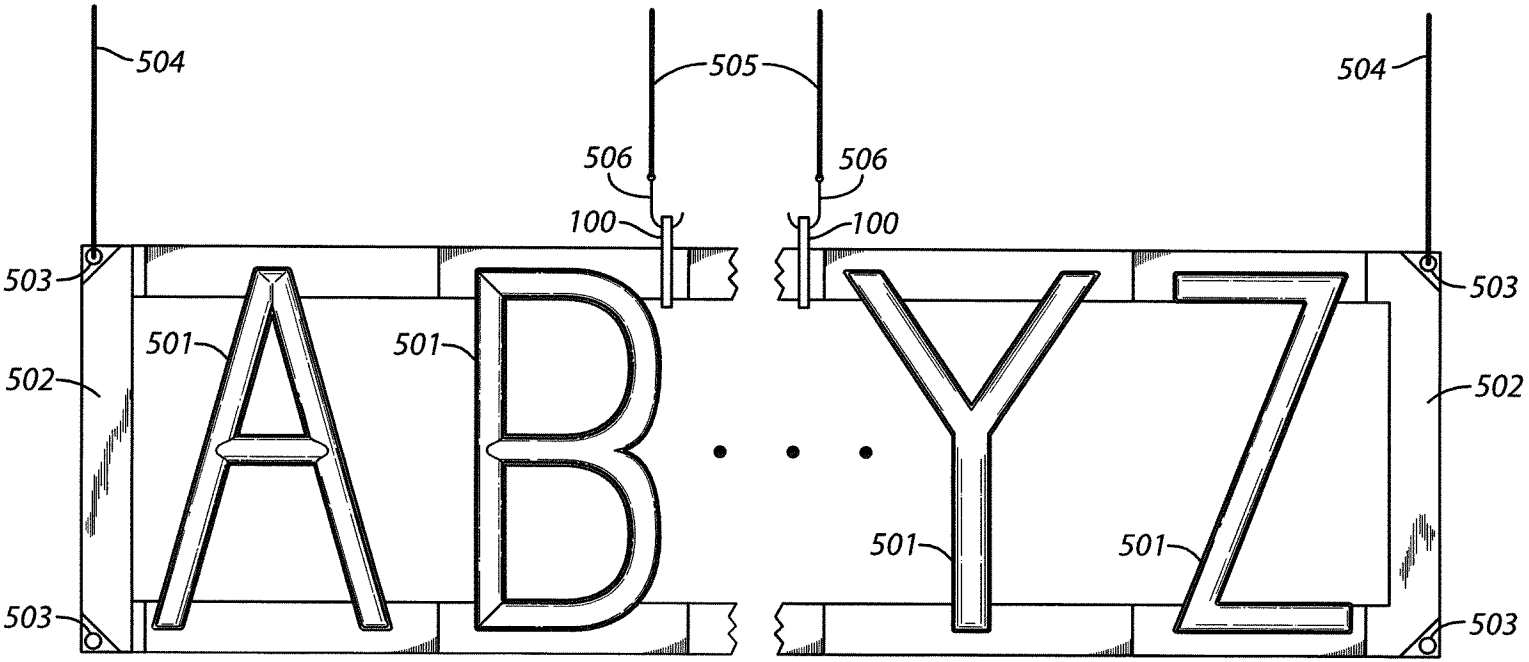
FIG. 5 comprises a front elevational view as configured in accordance with various embodiments of the invention.

Referring now to FIG. 5, the foregoing assembly steps can be repeated as desired until achieving a completed sign 500 that comprises a plurality of selected physically-discrete sign components 501 that are serially connected to one another. Broken lines serve in this illustrative example to denote that the completed sign 500 can include essentially any number of such individual physically-discrete sign components 501 such as, for example, ten letters, fifteen letters, twenty letters, twenty-five letters, or some other number of alphabetic characters of choice.

In this illustrative example the completed sign 500 includes end pieces 502 that have, at their corners, holes 503. The upper-corner holes 503, in turn, can have flexible links 504 (such as string, cable, wire, chain, or the like) secured thereto and that extend upwardly to an overhead point of connection (not shown) such as, for example, a ceiling. So configured, the completed sign 500 will hang as generally desired.

In this illustrative example, the completed sign 500 also includes two of the aforementioned support components 100 coupled as described above (each between two adjacent ones of the physically-discrete sign components 501). Additional flexible links 505 that are also secured at their distal ends (not shown) to an overhead point of connection (not shown) are connected via the aforementioned plurality of openings 103 using, for example, an overhead support interface such as hooks 506. So configured, these support components 100 provide further overhead support to the completed sign 500. In particular, and depending upon where the user locates the support component 100 or components, the support component(s) 100 can help to prevent the completed sign 500 from bowing outwardly while suspended from above.

Figure 7:
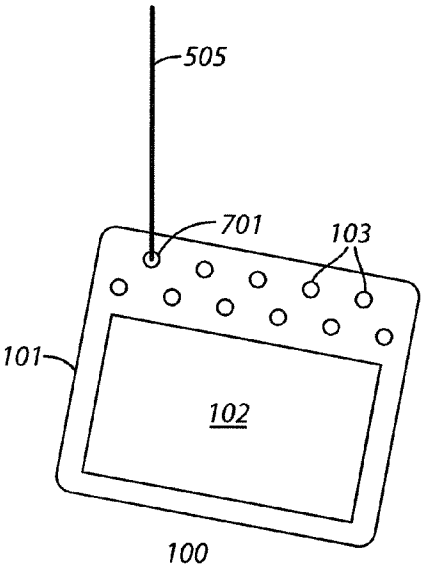
FIG. 7 comprises a side elevational view as configured in accordance with various embodiments of the invention.
Figure 6:
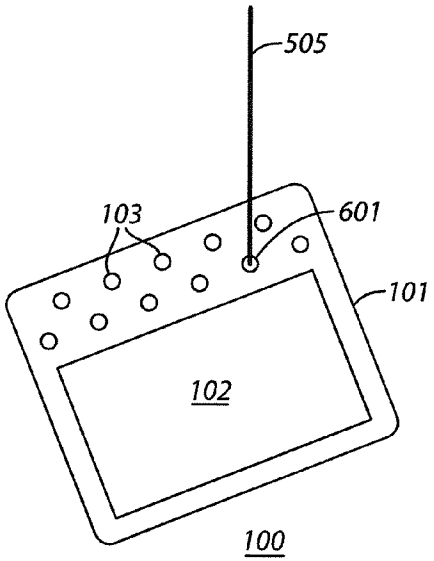
FIG. 6 comprises a side elevational view as configured in accordance with various embodiments of the invention.

These support components 100 can also serve, however, to adjust the pitch of the completed sign 500 (i.e., the angle by which at least a portion of the completed sign 500 tilts downwardly or upwardly). FIG. 6 provides one illustrative example in these regards. In this example, by securing the flexible link 505 to a particular one 601 of the openings 103 the tab 101 will tend to hang at a corresponding angle. FIG. 7 provides another, similar example where a different one 701 of the openings 103 results in a different hanging angle for the support component 100. Since the bar that passes through the non-circular hole 102 cannot rotate within that non-circular hole 102, the bar, too, will be angled accordingly. Accordingly, the pitch of the completed sign 500 can be readily set as desired by judiciously selecting the particular opening 103 to employ when using a given support component 100 to help to suspend the completed sign 500 from above.

Figure 8:
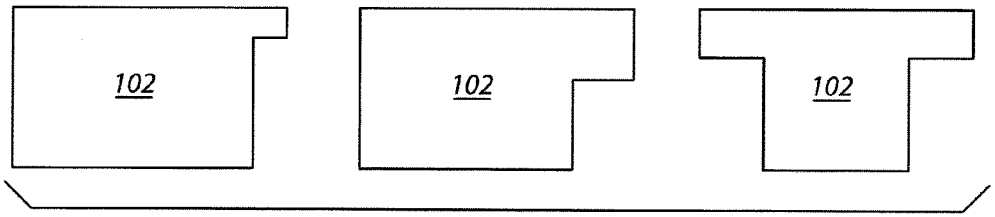
FIG. 8 comprises a front elevational schematic view as configured in accordance with various embodiments of the invention.
Figure 9:
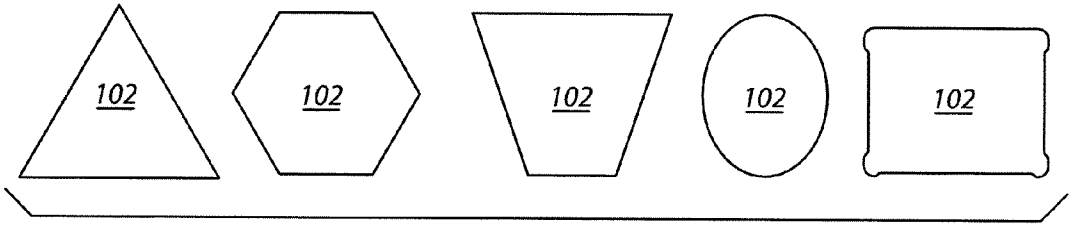
FIG. 9 comprises a front elevational schematic view as configured in accordance with various embodiments of the invention.

As noted above, the non-circular hole 102 can assume any of a wide variety of shapes to accommodate a corresponding variety of similarly-shaped bars. FIG. 8 illustrates three examples of non-circular holes 102 that represent variations from the rectangular form factor described above. FIG. 9, in turn, illustrates five examples of non-circular holes 102 that represent distinct geometries as compared to a pure rectangle.

Figure 10:
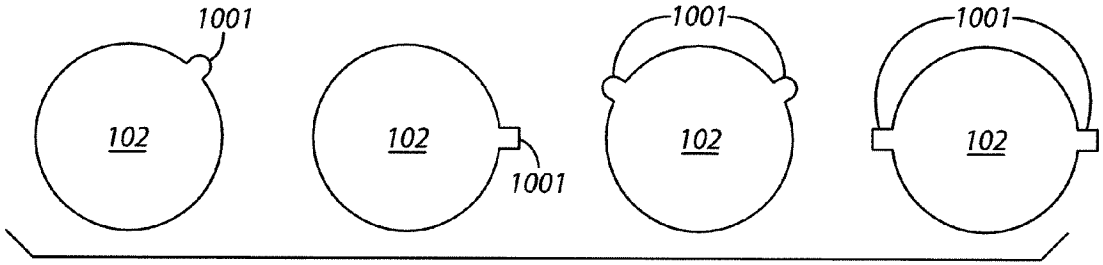
FIG. 10 comprises a front elevational schematic view as configured in accordance with various embodiments of the invention.

Furthermore, these teachings will accommodate a non-circular hole 102 that comprises, in part, a circular shape. FIG. 10, for example, illustrates four examples in these regards. In these examples, the non-circular holes 102 comprise circles that further include keys 1001 that protrude outwardly from the circle's perimeter to provide, in combination, a non-circular shape of interest.

Figure 11:
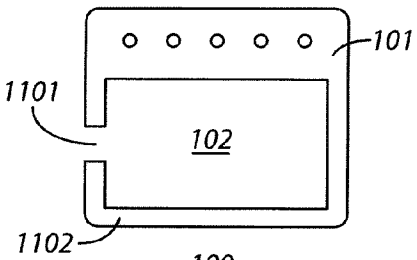
FIG. 11 comprises a front elevational view as configured in accordance with various embodiments of the invention.

In the examples provided above, the non-circular hole 102 is completely enclosed by the tab 101. The present teachings will accommodate other approaches in these regards, however, too. For example, as illustrated in FIG. 11, the tab 101 can include a gap 1101 that interrupts the perimeter of the non-circular hole 102. Presuming the tab 101 to be comprised of a somewhat flexible (albeit resilient) material, such a configuration can permit the support component 100 to be installed on a completed sign or other item by bending the lower portion 1102 of the tab 101 to fit the tab 101 about the corresponding bar.

Figure 12:
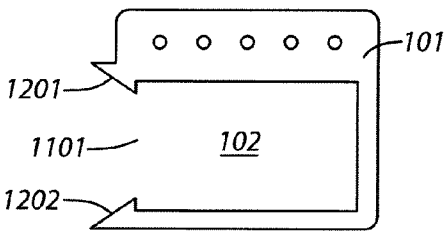
FIG. 12 comprises a front elevational view as configured in accordance with various embodiments of the invention.

FIG. 12 illustrates another example in these same regards. In this example, the aforementioned gap 1101 is bounded by inclined catches 1201 and 1202. Such a configuration may ease the installation of the support component 100 by permitting the tab 101 to be more-or-less pushed into place and with the catch surfaces serving to captivate the tab 101 about the bar.

Figure 14:
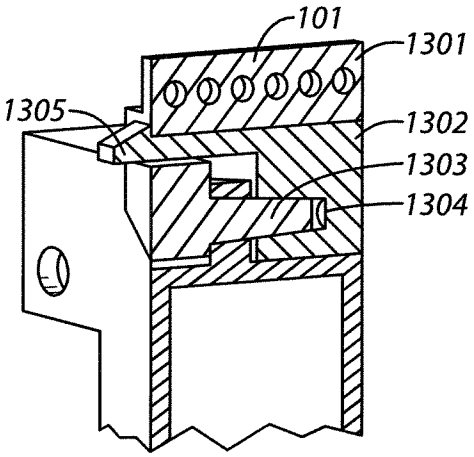
FIG. 14 comprises a perspective sectioned view as configured in accordance with various embodiments of the invention.
Figure 13:
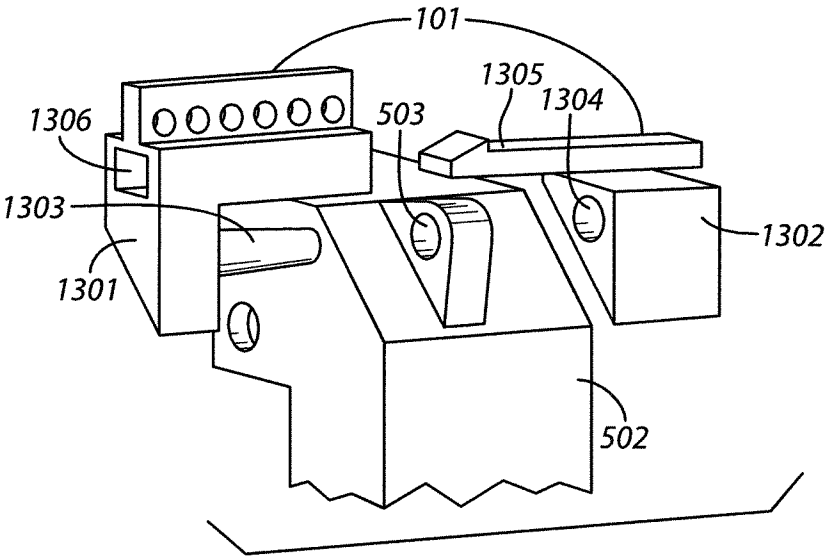
FIG. 13 comprises a perspective view as configured in accordance with various embodiments of the invention.

These teachings will also accommodate forming the tab 101 of two or more pieces rather than as a single integral one-piece component if desired. FIGS. 13 and 14 provide one illustrative example in these regards. In this illustrative example the tab 101 comprises two separate pieces 1301 and 1302. The first piece 1301 includes a stem 1303 that is sized and configured to fit through the aforementioned hole 503 in the sign end piece 502 described above and to then be received within a corresponding hole 1304 in the second piece 1302. A corresponding snap-fit member 1305 on the second piece 1302 is received through a corresponding hole 1306 through the first piece 1301 to thereby secure these two pieces 1301 and 1302 in place in an installed state.

Figure 15:
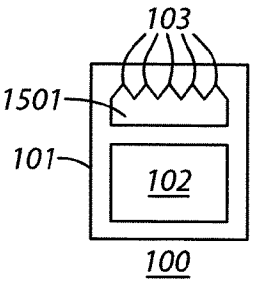
FIG. 15 comprises a front elevational view as configured in accordance with various embodiments of the invention.

As noted above, the foregoing examples presumed the captivation points to be openings 103 and, in particular, individual physically-discrete holes. These teachings, however, will accommodate other kinds of captivation points. As a first example in these regards, FIG. 15 depicts a support component 100 wherein the captivation points comprise a plurality of angular notches 103 that collectively share a common cutaway portion 1501. In this illustrative example the angular notches 103 abut one another (akin to the triangular-shaped teeth of a sawblade). It would be possible, however, to space these angular notches 103 further apart from one another if desired.

Figure 16:
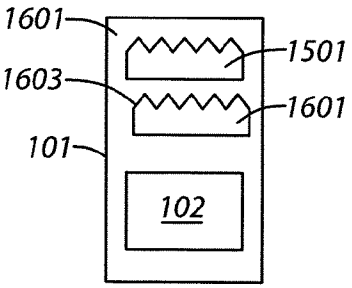
FIG. 16 comprises a front elevational view as configured in accordance with various embodiments of the invention.

FIG. 16 depicts an example having two sets 1602 and 1603 of captivation-point angular notches. The first set 1602 of captivation-point angular notches share a first common cutaway portion 1501 as described above with respect to FIG. 15. The second set 1603 of captivation-point angular notches, in turn, share a second common cutaway portion 1601 that is disposed below the first set 1602 of captivation-point angular notches. By one approach the second set 1603 of angular notches are laterally offset with respect to the first set 1602 of angular notches to increase the granularity of availabe pitch-adjustment opportunities.

Figure 17:
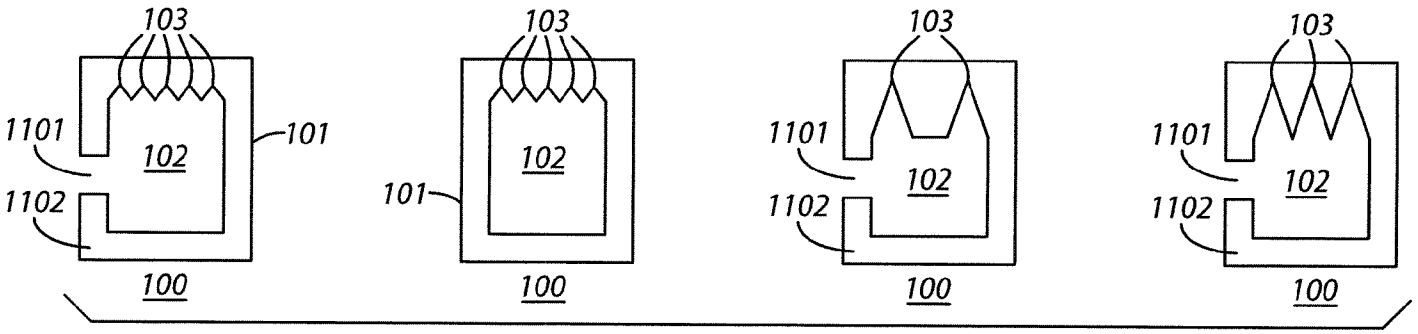
FIG. 17 comprises four front elevational views as configured in accordance with various embodiments of the invention.

FIG. 17 offers four further possible embodiments that again provide captivation points 103 as a plurality of angular notches arranged in line. In all of these examples the aforementioned opening 102 for the bar also includes, along its upper periphery, the aforementioned angular notches. The examples having the gap 1101 in the tab 101 could further include the aforementioned inclined catches 1201 and 1202 as described above with respect to FIG. 12 if so desired.

Figure 18:
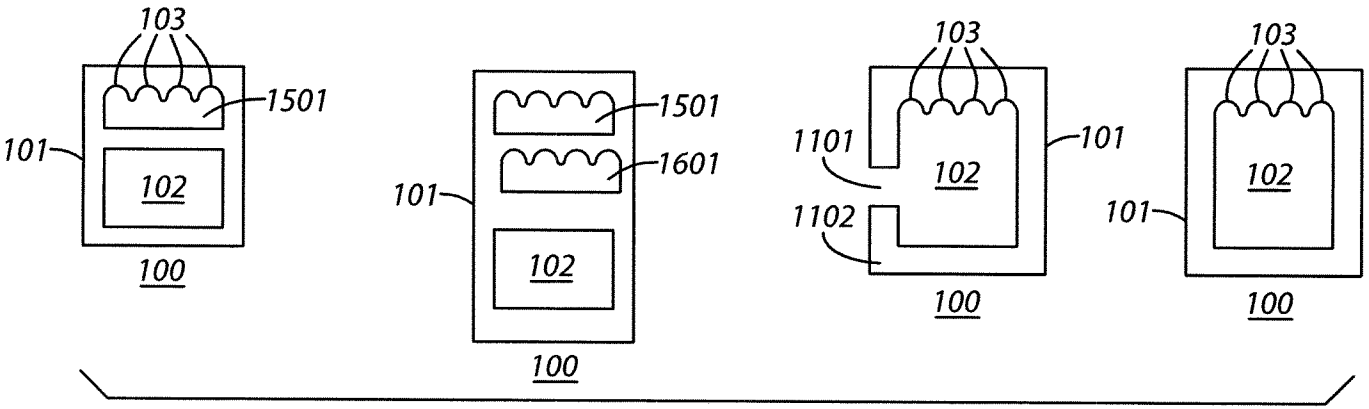
FIG. 18 comprises four front elevational views as configured in accordance with various embodiments of the invention.
Figure 19:
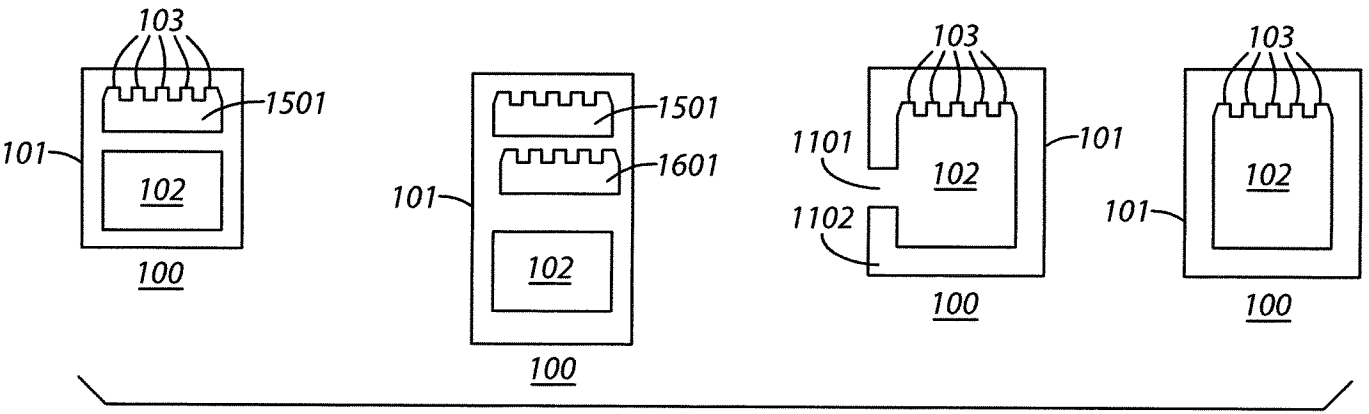
FIG. 19 comprises four front elevational views as configured in accordance with various embodiments of the invention.

By way of further illustrating the flexibility of what may comprise a captivation point, FIG. 18 presents four different approaches (generally akin to the approaches illustrated in FIGS. 15-17 as described above) to using a series of arcuate notches as the captivation points 103. And FIG. 19 presents a similar set of four approaches that use a series of square (or rectangular) notches as the captivation points 103.

Figure 20:
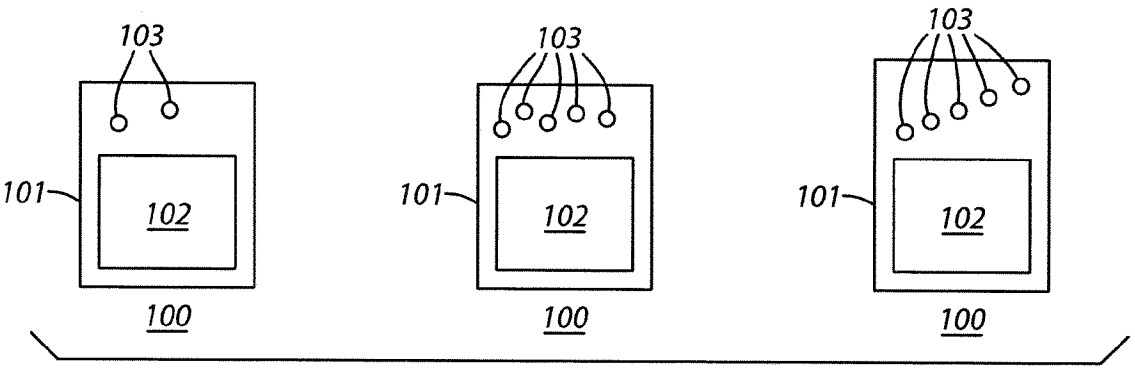
FIG. 20 comprises three front elevational views as configured in accordance with various embodiments of the invention.

FIG. 20, in turn, illustrates other approaches to the use of small holes as the captivation points 103. In these examples, the tab 101 includes as few as only two such holes and as many as five or six such holes. As a further exemplification of the flexibility of these teachings, some or all of these holes can be horizontally offset with respect to one another. The manner in which this offsetting occurs can vary as desired, and can include, for example, a somewhat random approach as illustrated to a diagonal ordering of some or all of the holes.

Figure 21:
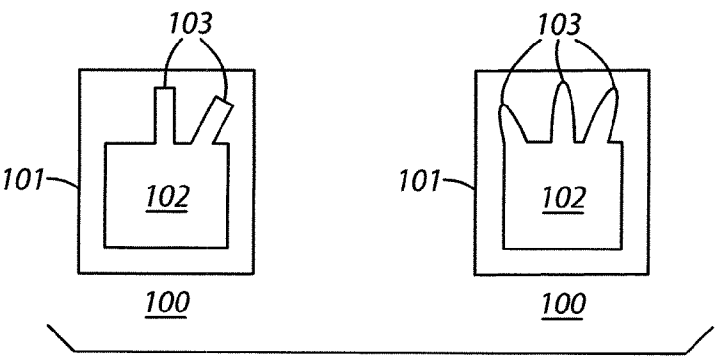
FIG. 21 comprises a pair of front elevational views as configured in accordance with various embodiments of the invention.

FIG. 21 offers further illustrative examples to underscore the point that the number and shape of the captivation points 103, as well as their general orientation to one another and/or to the rod-receiving opening 102 can vary as desired.

Figure 22:
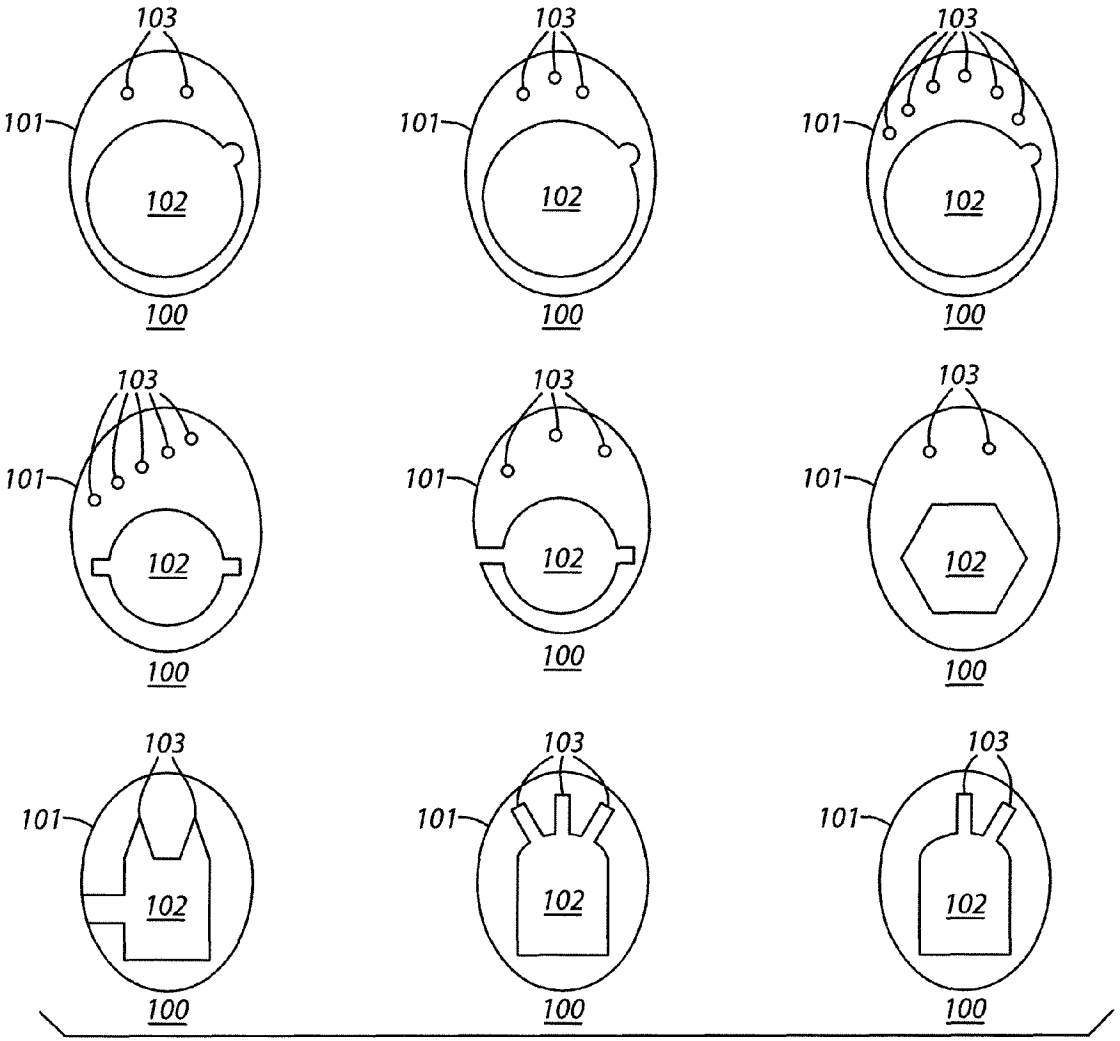
FIG. 22 comprises nine front elevational views as configured in accordance with various embodiments of the invention.

Just as the form and orientation of the captivation points 103 can vary as desired, and as the rod-receiving opening 102 can vary as well (as described above, for example, with respect to FIGS. 8-10), the present teachings will similarly accommodate great flexibility with respect to the external periphery of the tab 101 itself. By way of some examples in these regards, FIG. 22 illustrates a variety of approaches that draw from various examples discussed and/or illustrated above where the tab 101 has an oval shape rather than the generally-rectangular shape suggested above.

Accordingly, it will be understood that notwithstanding the various specific details and examples provided herein, these teachings are highly flexible in practice and can be practiced in any number of ways to accommodate, for example, a wide variety of application settings.

Those skilled in the art will recognize that a wide variety of modifications, alterations, and combinations can be made with respect to the above described embodiments without departing from the spirit and scope of the invention, and that such modifications, alterations, and combinations are to be viewed as being within the ambit of the inventive concept.

We claim:

1. A sign comprising:

a plurality of physically-discrete sign components that are serially attached to one another and where the physically-discrete sign components each include at least one bar;

a support component disposed and coupled between two of the physically-discrete sign components that are adjacent to one another and where the bars of the two physically-discrete sign components are coupled to one another, wherein the support component includes:

at least one captivation point disposed therethrough that are each configured to receive an overhead support interface such that the at least one of the captivation point provides overhead support to the sign; and an opening through which at least one of the bars of the two physically-discrete sign components is disposed.

2. The sign of claim 1 wherein the opening comprises a non-circular hole.

3. The sign of claim 2 wherein the non-circular hole comprises a rectangle.

4. The sign of claim 1 wherein the support component comprises a substantially resilient support component.

5. The sign of claim 4 wherein the at least one captivation point comprises a plurality of captivation points.

6. The sign of claim 5 wherein at least some of the captivation points comprise discrete holes formed through the support component.

7. The sign of claim 5 wherein at least some of the captivation points comprise notches formed in the support component.

8. A sign comprising:

a plurality of physically-discrete sign components that each present an alphanumeric character and that are serially attached to one another to form a completed alphanumeric expression;

a discrete support component that physically engages the serially-attached plurality of physically-discrete sign components, wherein the discrete support component includes at least one captivation point disposed therethrough that is configured to receive an overhead support interface such that the captivation point provides overhead support to the sign, and wherein the discrete support component physically engages the serially-attached plurality of physically-discrete sign components by engaging a physical connection between two adjacent ones of the physically-discrete sign components.

9. A sign comprising:

a plurality of physically-discrete sign components that each present an alphanumeric character and that are serially attached to one another to form a completed alphanumeric expression;

a discrete support component that physically engages the serially-attached plurality of physically-discrete sign components, wherein the discrete support component includes at least one captivation point disposed therethrough that is configured to receive an overhead support interface such that the captivation point provides overhead support to the sign, and wherein the discrete support component comprises at least two separate pieces that connect to one another.

10. The sign of claim 9 wherein at least one of the separate pieces of the discrete support component comprises a plate.

11. The sign of claim 9 wherein the two separate pieces of the discrete support component connect to one another via a snap fit.

12. A sign comprising:

a plurality of physically-discrete sign components that each present an alphanumeric character and that are serially attached to one another to form a completed alphanumeric expression;

a discrete support component that physically engages the serially-attached plurality of physically-discrete sign components, wherein the discrete support component includes at least one captivation point disposed therethrough that is configured to receive an overhead support interface such that the captivation point provides overhead support to the sign, and wherein the at least one captivation point comprises a plurality of captivation points.

13. The sign of claim 12 wherein at least some of the captivation points comprise discrete holes formed through the discrete support component.

14. The sign of claim 12 wherein at least some of the captivation points comprise notches formed in the discrete support component.

15. The sign of claim 12 wherein the plurality of captivation points are laterally offset from one another to thereby facilitate selecting a particular pitch orientation for the sign.

* * * * *